US006623291B1

(12) United States Patent
Tsai

(10) Patent No.: US 6,623,291 B1
(45) Date of Patent: Sep. 23, 2003

(54) DECORATIVE LIGHT WITH AN INNER LOCKING DEVICE

(76) Inventor: George Tsai, 4th Fl., No. 403, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 10/101,190

(22) Filed: Mar. 20, 2002

(51) Int. Cl.[7] ..... H01R 13/627
(52) U.S. Cl. ..... 439/356; 436/619
(58) Field of Search ..... 439/356, 316, 439/375, 358, 619, 903; 362/226, 806; 313/318.01, 318.05, 318.12, 49, 51

(56) References Cited

U.S. PATENT DOCUMENTS 3,941,447 A * 3/1976 Hargrave et al. ..... 439/356
4,837,479 A * 6/1989 Devir et al. ..... 439/619 X
5,418,698 A * 5/1995 Wu ..... 362/226 X

* cited by examiner

*Primary Examiner*—Renee Luebke
(74) *Attorney, Agent, or Firm*—Rabin & Berdo, P.C.

(57) ABSTRACT

A decorative light has a lamp holder, a socket inserted into the lamp holder and a bulb mounted in the socket. The lamp holder has two upper protrusions and two lower protrusions formed on opposite sides of the inner periphery of the lamp holder. The socket has two locking segments formed on an outer periphery of the socket, wherein each locking segment is defined with an opening to clamp the upper protrusion on the lamp holder. By such an arrangement, the locking device between the lamp holder and socket is an inner structure. The socket will not be dislodged from the lamp holder by an inadvertent force.

1 Claim, 3 Drawing Sheets

DECORATIVE LIGHT WITH AN INNER LOCKING DEVICE

BACKGROUND OF THE INVENTION

1. Field of the Invention

The present invention relates to a decorative light, and more particularly to a decorative light with a locking device between the lamp holder and socket of the light.

2. Description of Related Art

A conventional decorative light mainly comprises a lamp holder, a socket inserted into the lamp holder and a bulb arranged in the socket. Two electric wires are inserted into the bottom of the lamp holder and electrically connect to the two bulb electrodes to provide electricity to the bulb. Because the engagement between the lamp holder and socket is not adequate to withstand a large external force or a pull, there is usually a locking device to enhance the combination between the lamp holder and socket. However, the conventional locking device for the decorative light is on the outside of the lamp holder, so the socket still can be dislodged from the lamp holder by a force applied in an appropriate direction or a pulling force.

To overcome the shortcomings, the present invention provides an improved decorative light to mitigate or obviate the aforementioned problems.

SUMMARY OF THE INVENTION

The main objective of the invention is to provide an improved decorative light having two opposite protrusions formed. in the inner periphery of the lamp holder, and two through holes defined on an outer periphery of the socket to clamp with the two protrusions. Using such an arrangement, the lock device between the lamp holder and socket is an inner structure. Consequently, the socket will not dislodge from the lamp holder by an inadvertent force.

Other objects, advantages and novel features of the invention will become more apparent from the following detailed description when taken in conjunction with the accompanying drawings.

DETAILED DESCRIPTION OF PREFERRED EMBODIMENT

Figure 1:
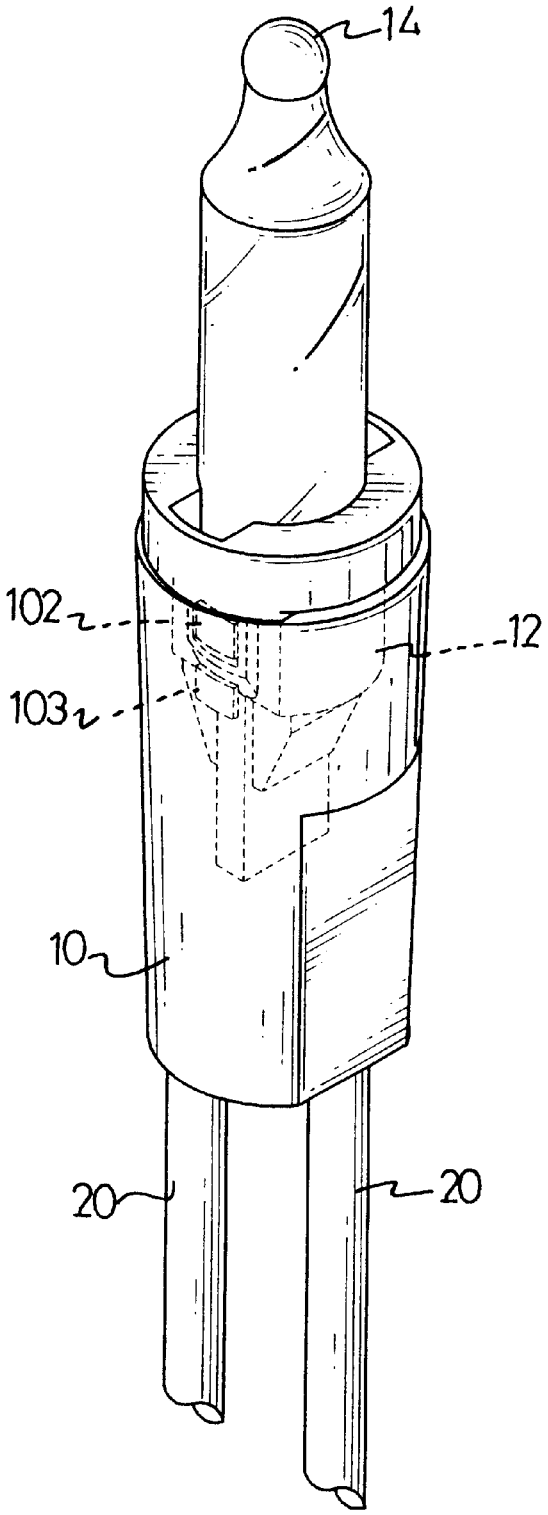
FIG. 1 is a perspective view of a decorative light in accordance with the present invention.
Figure 2:
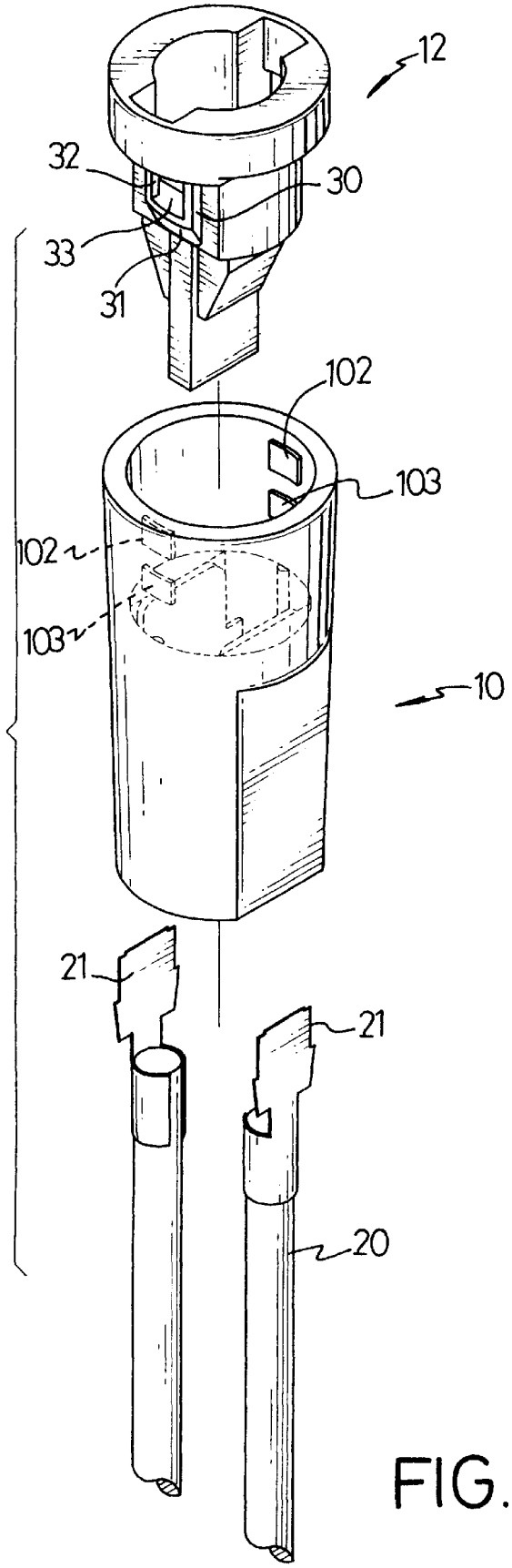
FIG. 2 is an exploded perspective view of the decorative light in FIG. 1.
Figure 3:
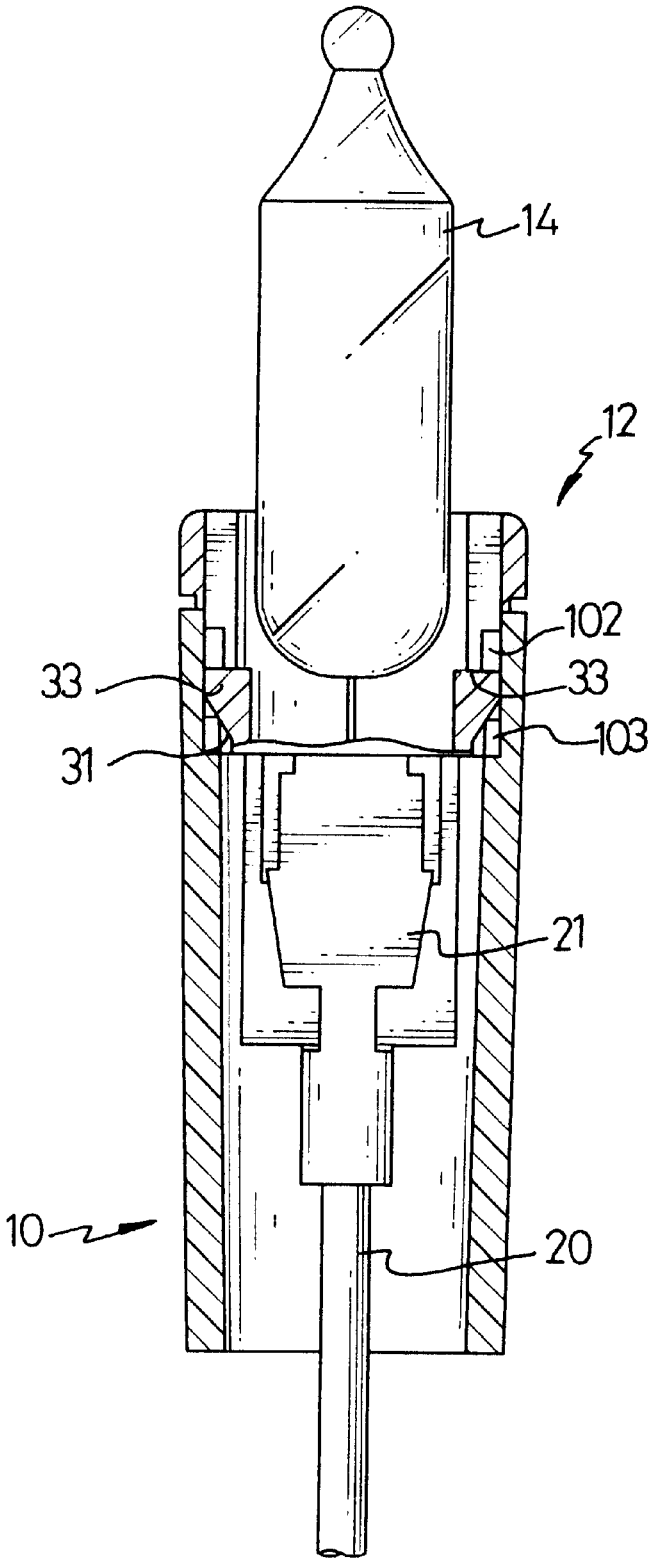
FIG. 3 is a side plan view in partial section of the decorative light in FIG. 1.

With reference to FIGS. 1–3, a decorative light in accordance with the present invention comprises a lamp holder (10), a socket (12) and a bulb (14). The lamp holder (10) has an open top end and a bottom end. The socket (12) is inserted into the open top end of the lamp holder (10). The bulb (14) is retained in the socket (12). Two electric wires (20) are inserted into the bottom of the lamp holder (10) and are electrically connected to the two electrodes (not numbered) of the bulb (14) by two conductive plates (21), such as copper plates, to provide electricity to the bulb (14).

Two upper protrusions (102) and two lower protrusions (103) are integrally formed on opposite sides of the inner periphery of the lamp holder (10), wherein each upper protrusion (102) is in alignment with a corresponding lower protrusion (103).

Two locking segments (30) are integrally formed on opposite sides of the outer surface of the socket (12) and extend outward from the outer surface of the socket (12). A substantially oblique surface (31) is formed at the lower part of each locking segment (30). Each locking segment (30) is defined with a through opening (32) at the upper part, whereby a lower edge of the opening (32) is formed as a platform portion (33).

When the socket (12) is inserted into the lamp holder (10), the two upper protrusions (102) are correspondingly received in the two openings (32).

Consequently, the socket (12) is securely held in the lamp holder (10) by the engagement between each protrusion (102) and the corresponding opening (32).

By such an arrangement, because the protrusions (102) and the openings (32) are inside structures, an outer force cannot be directly applied to the locking device when the socket (12) is inserted into the lamp holder (10). Consequently, even when a pulling force is applied to the socket (12), the socket (12) still will not be dislodged from the lamp holder (10) since the lower edge of the protrusion (102) is against the platform (33).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative light with an inner locking device, the decorative light comprising:

a lamp holder having two upper protrusions formed on opposite sides of an inner periphery of the lamp holder and having two lower protrusions formed on opposite sides of the inner periphery of the lamp holder, wherein the two upper protrusion are respectively in alignment with the lower protrusions;

a socket inserted into the lamp holder and having two opposite locking segments formed on and extending from an outer surface of the socket, wherein two through holes are respectively defined in an upper part of each locking segment to receive the two upper protrusions, and each locking segment has a substantially oblique surface formed at a lower part of the locking segment to abut the lower protrusions;

wherein a platform is formed on a lower face defining each through hole, and when the socket is inserted into the lamp holder and pulled upward, a lower edge of each upper protrusion tightly abuts the respective platforms to prevent the socket from disengaging from the lamp holder; and a bulb retained in the socket.

* * * * *